US007665723B2

(12) United States Patent
Gogoana

(10) Patent No.: US 7,665,723 B2
(45) Date of Patent: Feb. 23, 2010

(54) SHEET FEEDING APPARATUS AND METHOD

(75) Inventor: Marian Gogoana, Fairfax, VA (US)

(73) Assignee: YSHAPE Inc., Falls Church, VA (US)

( * ) Notice: Subject to any disclaimer, the term of this patent is extended or adjusted under 35 U.S.C. 154(b) by 315 days.

(21) Appl. No.: 11/533,960

(22) Filed: Sep. 21, 2006

(65) Prior Publication Data

US 2007/0075480 A1 Apr. 5, 2007

Related U.S. Application Data

(60) Provisional application No. 60/721,990, filed on Sep. 30, 2005.

(51) Int. Cl.
*B65H 3/46* (2006.01)
*B65H 3/08* (2006.01)

(52) U.S. Cl. ..... 271/106; 271/107; 271/98; 271/104

(58) Field of Classification Search ..... 271/97, 271/98, 90, 91, 93, 106, 107, 104, 103, 102
See application file for complete search history.

(56) References Cited

U.S. PATENT DOCUMENTS

| | | | | |
|---|---|---|---|---|
| 1,929,361 | A * | 10/1933 | Liljebladh | 271/106 |
| 3,980,293 | A * | 9/1976 | Shelmire | 271/93 |
| 4,451,028 | A * | 5/1984 | Holmes et al. | 271/11 |
| 4,506,876 | A * | 3/1985 | Nishibori | 271/104 |
| 6,345,818 | B1 * | 2/2002 | Stephan et al. | 271/91 |
| 6,969,060 | B2 * | 11/2005 | Bouchal et al. | 271/98 |
| 2004/0217540 | A1 * | 11/2004 | Sinai et al. | 271/98 |

* cited by examiner

*Primary Examiner*—Patrick H Mackey
*Assistant Examiner*—Luis Gonzalez
(74) *Attorney, Agent, or Firm*—Nixon & Vanderhye, P.C.

(57) ABSTRACT

A sheet feeder (20) and method of operation thereof feeds sheets in a conveyance direction (30). The sheet feeder (20) comprises a sheet hopper (22); a sheet deflector (24); and a sheet extractor (26). The sheet deflector (24) is arranged for deflecting a top sheet-to-be-fed (32) from a sheet stack (28) from a sheet undeflected acquisition position to a sheet deflected position. The sheet deflector (24) has a major axis (34) oriented essentially parallel to a trailing edge the top sheet-to-be-fed from the sheet stack (28). The sheet deflector (24) is arranged to undergo three degrees of motion including selective rotation about its major axis for moving the top sheet-to-be-fed from the sheet undeflected acquisition position to the sheet deflected position.

8 Claims, 5 Drawing Sheets

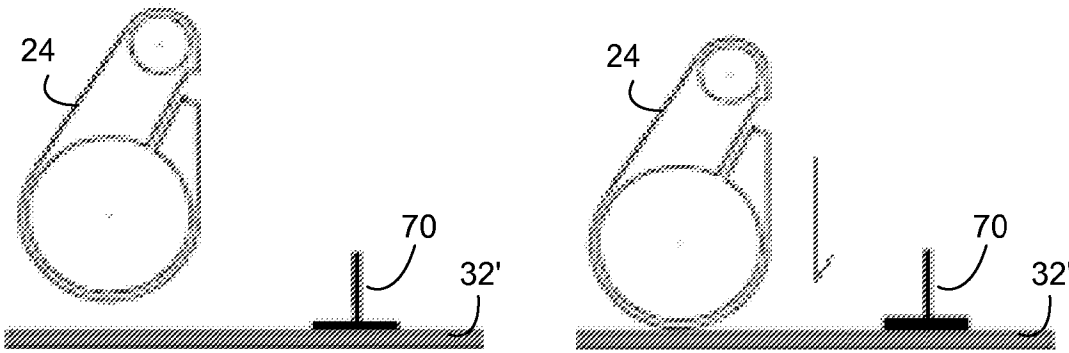
Fig. 4G
Fig. 4H
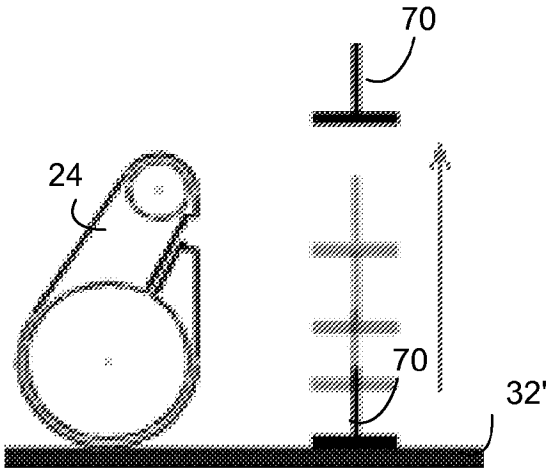
Fig. 4I

SHEET FEEDING APPARATUS AND METHOD

This application claims the benefit and priority of U.S. provisional patent application 60/721,990 filed Sep. 30, 2005, which is incorporated herein by reference in its entirety.

BACKGROUND

I. Technical Field

This invention pertains to sheet handling, and particularly to the automated feeding of sheets.

II. Related Art and Other Considerations

Feeders are widely used in the paper handling industry. However, special designs are required for extremely thin, statically charged sheets. Conventional paper feeders on the market cannot reliably separate these pages, as they tend to cling together. As a result, double feeding takes place, making the separation of sheets very important. Manual feeding is the only alternative in these instances.

What is needed, therefore, and an object herein provided, are method, technique, apparatus, for the efficient and effective feeding of sheets, particularly statically-charged thin sheets.

BRIEF SUMMARY

A sheet feeder apparatus and method feeds sheets in a conveyance direction. The apparatus comprises a sheet hopper; a sheet deflector; and a sheet extractor. The sheet hopper is adapted for orienting sheets-to-be-fed in a stack, the sheets of the stack lying essentially parallel to the conveyance direction while lying undeflected in the sheet hopper.

The sheet deflector is arranged for deflecting a top sheet-to-be-fed from the sheet stack from a sheet undeflected acquisition position to a sheet deflected position. The sheet deflector has a major axis oriented essentially parallel to a trailing edge the top sheet-to-be-fed from the sheet stack. The sheet deflector has a port through which suction is selectively applied to the top sheet-to-be-fed.

The sheet deflector is arranged to undergo three degrees of motion. As a first degree of motion, the sheet deflector is arranged for selective rotation about its major axis for moving the top sheet-to-be-fed from the sheet undeflected acquisition position to the sheet deflected position (while, e.g., suction is applied through the port). In so doing, the sheet deflector also experiences its second degree of motion, e.g., selective translation in a plane parallel to the conveyance direction from a nominal position to sheet acquisition position (the sheet acquisition position being closer to the trailing edge of the top sheet-to-be-fed from the sheet stack than the nominal position). As a third degree of motion, the sheet deflector is arranged for selective translation in a direction perpendicular to the conveyance direction for selectively lifting the top sheet-to-be-fed from the sheet stack in the sheet deflected position and selectively resting on the sheet stack.

The sheet extractor is arranged for engaging at least a leading edge of the top sheet-to-be-fed when the top sheet-to-be-fed is in its sheet deflected position and for directing the top sheet-to-be-fed in the conveyance direction.

In an example embodiment, the sheet feeder also comprises a separator for separating the top sheet-to-be-fed when in its sheet deflected position from a remainder of the stack. In one example For example implementation, the separator comprises a source of fluid for blowing fluid between the top sheet-to-be-fed when in its sheet deflected position and the sheet stack for separating the top sheet-to-be-fed from the remainder of the stack.

In an example embodiment, the sheet feeder also comprises a sheet singulator for separating the top sheet-to-be-fed when in its sheet deflected position from another sheet which may be in its sheet deflected position and thereby returning the another sheet to the sheet stack. In an example implementation, the sheet singulator comprises a source of fluid for blowing fluid between the top sheet-to-be-fed when in its sheet deflected position and another sheet which may be in its sheet deflected position and thereby returning the another sheet to the sheet stack.

In an example embodiment, the sheet feeder also comprises a source of compressed gas for applying compressed gas through the port of the sheet deflector to the top sheet-to-be-fed when in its sheet deflected position and when the extractor is engaging the top sheet-to-be-fed.

In an example embodiment, the sheet feeder also comprises a controller for controlling timing of aspects of operation of the sheet feeder. Among the aspects of operation of the sheet feeder supervised or timed by the controller are: (1) the rotation of the sheet deflector; (2) the application of suction though the port of the sheet deflector to the top sheet-to-be-fed; and, (3) the translation of the sheet deflector in the direction perpendicular to the conveyance direction.

In an example embodiment, the sheet deflector comprises a deflector cover, a fluid manifold; and a deflector rod. The port is defined in the deflector cover. The fluid manifold is situated within the deflector cover and in fluid communication with the port. The deflector rod is attached to the deflector cover and collinear with the major axis.

In an example embodiment, the deflector cover is configured with a predetermined profile in a cross section plane perpendicular to the major axis. The predetermined profile has a flat profile segment and a curved profile segment arranged whereby the sheet deflector rolls through at least a portion of its curved profile segment onto the top sheet-to-be-fed to bring the flat profile segment in flush contact with the top sheet-to-be-fed, the flat profile segment of the sheet deflector having the port provided therein.

In an example embodiment, the sheet feeder further comprises a holding arm; a deflector carriage, and an actuator. The holding arm is positioned and arranged for selectively contacting a next sheet-to-be-fed when the sheet extractor engages the top sheet-to-be-fed. The deflector carriage is arranged for carrying the sheet deflector and pivotally connected to the holding arm. The actuator serves for providing relative pivotal movement about a pivot axis of the holding arm and the deflector carriage.

In an example implementation, the deflector carriage comprises a carriage frame; a carriage actuator; and two guide belts. The carriage frame is pivotally connected to the holding arm has had two spaced-apart carriage projections extending therefrom. The carriage actuator has a first end connected to the carriage frame and a piston. The piston is rigidly connected to a bearing. The bearing permits rotation of the sheet deflector about the major axis of the sheet deflector. A first guide belt has a first end connected to a first of the two carriage projections and a second end connected to the bearing. A second guide belt has a first end connected to a second of the two carriage projections and a second end connected to the bearing. The first guide belt and the second guide belt are respectively wrapped in clockwise and counter-clockwise directions about the bearing.

Another aspect of the technology involves a method of operating a sheet feeder for feeding sheets in a conveyance direction. Basic steps involved in an example mode of the method comprises: (1) rotating the sheet deflector about a major axis of the sheet deflector into essentially flush contact with at portion of the trailing edge of the top sheet-to-be-fed from the sheet, thereby translating a sheet deflector from a nominal position to a sheet acquisition position in a plane parallel to a conveyance direction (the sheet acquisition position being closer to a trailing edge of a top sheet-to-be-fed from a sheet stack than the nominal position); (2) applying a vacuum through a port of the sheet deflector to attract the top sheet-to-be-fed to the sheet deflector; (3) rotating the sheet deflector about the major axis of the sheet deflector for moving the top sheet-to-be-fed from a sheet undeflected acquisition position to a sheet deflected position while the vacuum is applied through the port; (4) translating the sheet deflector in a direction perpendicular to the conveyance direction for selectively lifting the top sheet-to-be-fed from the sheet stack; (5) extracting the top sheet-to-be-fed from the sheet deflector in the conveyance direction; and, (6) returning the sheet deflector in the direction perpendicular to the conveyance direction to rest on the sheet stack.

Additional aspects of the method include further comprising separating the top sheet-to-be-fed when in its sheet deflected position from a remainder of the stack; and further comprising separating the top sheet-to-be-fed when in its sheet deflected position from another sheet which may be in its sheet deflected position and thereby returning the another sheet to the sheet stack.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIG. 4A-FIG. 4I are diagrammatic views of a portion of the automated sheet feeding apparatus of FIG. 1 during examples steps of operation of a feeding method according to an example mode.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other embodiments that depart from these specific details. That is, those skilled in the art will be able to devise various arrangements which, although not explicitly described or shown herein, embody the principles of the invention and are included within its spirit and scope. In some instances, detailed descriptions of well-known devices, circuits, and methods are omitted so as not to obscure the description of the present invention with unnecessary detail. All statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Figure 1:
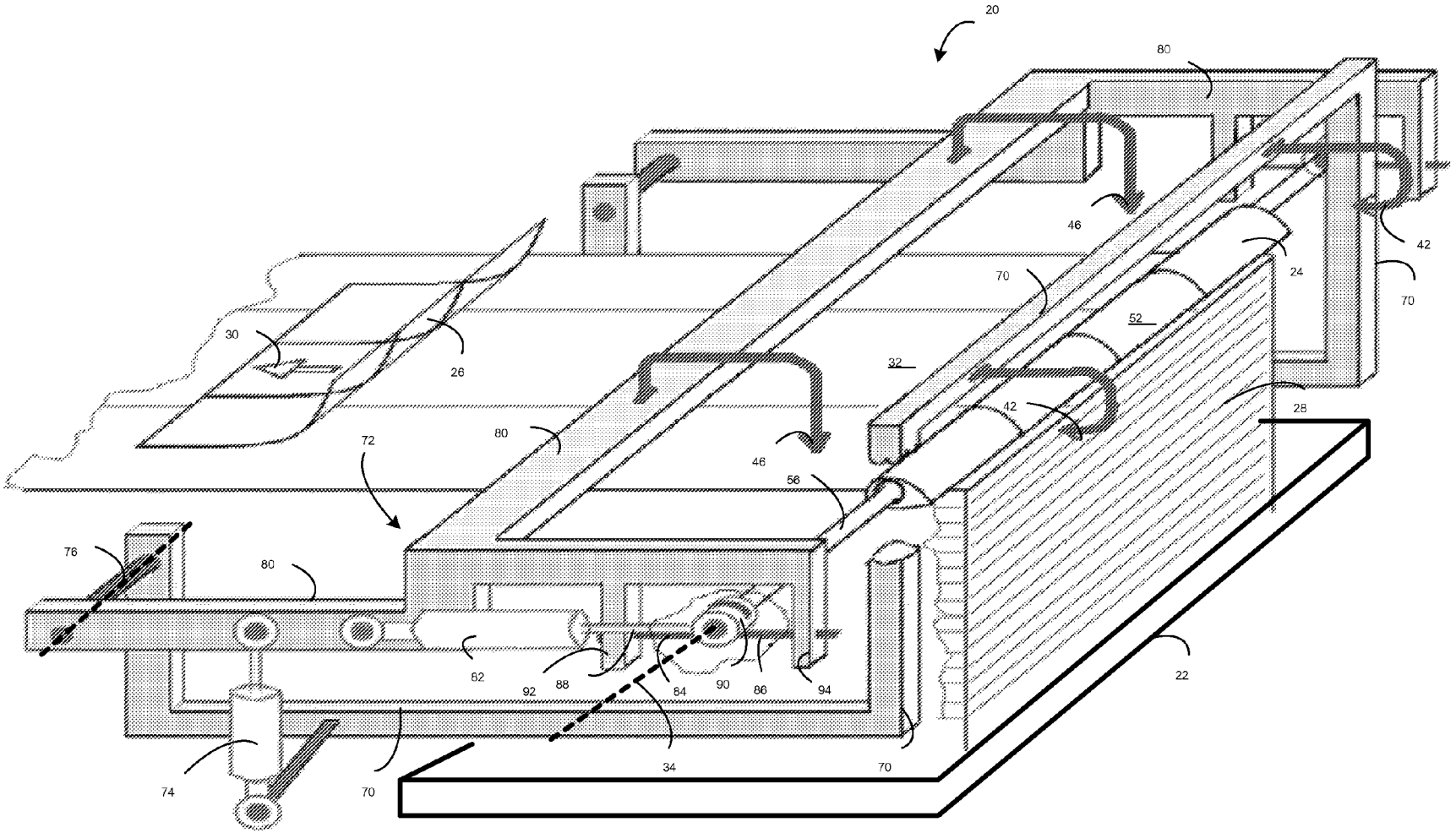
FIG. 1 is a diagrammatic view of an example embodiment of an automated sheet feeding apparatus.

FIG. 1 shows a sheet feeder apparatus 20 which generally comprises a sheet hopper 22; a sheet deflector 24; and a sheet extractor 26. The sheet hopper 22 is adapted for orienting sheets-to-be-fed in a stack 28, the sheets of the stack 28 lying essentially parallel to a conveyance direction 30 while lying undeflected in the sheet hopper 22.

The sheet deflector 24 is arranged for deflecting a top sheet-to-be-fed, i.e., sheet 32, from the sheet stack 28 from a sheet undeflected acquisition position to a sheet deflected position. The sheet deflector has a major axis (shown by broken line 34) oriented essentially parallel to a trailing edge the top sheet-to-be-fed (sheet 32) from the sheet stack. A trailing edge of sheet 32 is understood with respect to the direction of conveyance depicted by arrow 30. As shown in more detail with reference to FIG. 4A-FIG. 4I, sheet deflector 24 has a port 36 through which suction is selectively applied to the top sheet-to-be-fed (sheet 32).

The sheet deflector 24 is arranged for undergoing or experiencing three degrees or types of motion/displacement. As a first degree of motion, the sheet deflector 24 is arranged for selective rotation about its major axis 34 for moving the top sheet-to-be-fed (sheet 32) from the sheet undeflected acquisition position to the sheet deflected position (while, e.g., suction is applied through the port 36). In so doing, the sheet deflector also experiences its second degree of motion, e.g., selective translation in a plane parallel to the conveyance direction 30 from a nominal position to sheet acquisition position (the sheet acquisition position being closer to the trailing edge of the top sheet-to-be-fed from the sheet stack than the nominal position). As a third degree of motion, the sheet deflector 24 is arranged for selective translation in a direction perpendicular to the conveyance direction for selectively lifting the top sheet-to-be-fed (sheet 32) from the sheet stack 28 in the sheet deflected position and selectively resting on the sheet stack 28. These motions will subsequently be described with reference to FIG. 4A-4E.

The sheet extractor 26 is arranged for engaging at least a leading edge of the top sheet-to-be-fed (sheet 32) when the top sheet-to-be-fed is in its sheet deflected position and for directing the top sheet-to-be-fed in the conveyance direction. In an example embodiment, sheet extractor 26 takes the form of one or more suction belts (e.g., vacuum conveyor belt) and/or other transport mechanism, such as rollers or grippers, for example. As desired, the sheet extractor 26 can be positioned to contact/operate upon either one or both faces of a sheet being extracted. The sheet extractor 26 permanently glides on the upper sheet 32, pulling sheet (sheet 32) to the next processing machine. The sheet 32 actually moves only when it escapes sheet deflector 24.

The sheet feeder 20 also optionally comprises a separator 40 for separating the top sheet-to-be-fed when in its sheet deflected position from a remainder of the stack. In one example For example implementation, the separator comprises a source of fluid exiting through a nozzle or the like (e.g., a small air tube) in the manner depicted by arrow 42 in FIG. 1 for blowing fluid between the top sheet-to-be-fed (sheet 32) when in its sheet deflected position and the sheet stack 28 for separating the top sheet-to-be-fed from the remainder of the stack 28 and assisting in the directing of the sheet 32 in the conveyance direction 30. The nozzles of separator 40 are preferably mounted on holding arm 70 as shown in FIG. 1 to direct fluid in the direction of arrow 42.

The suction applied by sheet deflector 24 may bend not only the leading edge of the top sheet-to-be-fed (e.g., sheet 32), but the second sheet-to-be-fed also (e.g., sheet 32'). To cater to this possibility, the sheet feeder also optionally comprises a sheet singulator 44 for separating the top sheet-to-be-fed when in its sheet deflected position from another sheet which also may be in its sheet deflected position (e.g., sheet 32') and thereby assisting in the return of the another/second sheet to the sheet stack. In an example implementation, the sheet singulator 44 comprises a source of fluid for blowing fluid in a direction depicted by arrow 46 between the top sheet-to-be-fed (sheet 32) when in its sheet deflected position and another sheet which may be in its sheet deflected position and thereby returning the another sheet to the sheet stack 28. The separation is facilitated by the fact that the bending of the leading edge of the top sheet 32 creates a stress in the second sheet 32', making easier the separation operation.

In an example embodiment, the sheet feeder 20 also comprises a source 48 of compressed gas for applying compressed gas through the port 36 of the sheet deflector 24 to the top sheet-to-be-fed when in its sheet deflected position and when the extractor is engaging the top sheet-to-be-fed.

Figure 3:
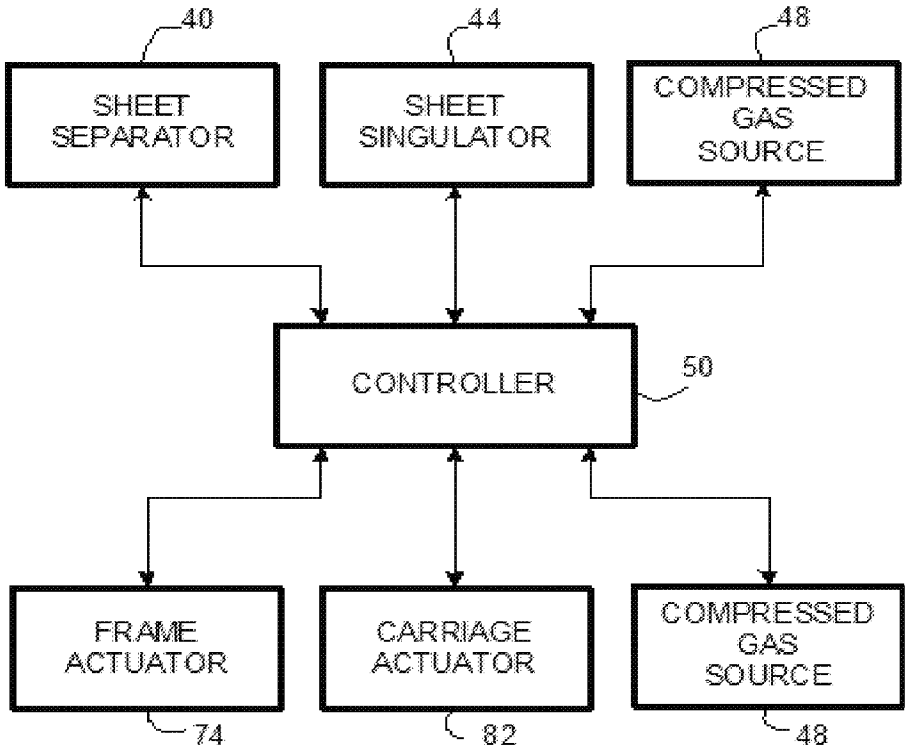
FIG. 3 is a schematic view of connections of a controller of the automated sheet feeding apparatus of FIG. 1.

In an example embodiment, the sheet feeder 20 also comprises a controller 50 for controlling timing of (e.g., sequencing) aspects of operation of the sheet feeder 20. Among the aspects of operation of the sheet feeder 20 supervised or timed by the controller 50 are: (1) the rotation of the sheet deflector 24; (2) the application of suction though the port 36 of the sheet deflector 24 to the top sheet-to-be-fed (sheet 32); and, (3) the translation of the sheet deflector 24 in the direction perpendicular to the conveyance direction 30. To this end, FIG. 3 shows controller 50 as being connected to each of separator 40, sheet singulator 44, compressed gas source 48, frame actuator 74, and carriage actuator 82.

The role of controller 50 may be played by a "processor" or "controller", and as such may be provided through the use of dedicated hardware as well as hardware capable of executing software in association with appropriate software. When provided by a processor, the functions may be provided by a single dedicated processor, by a single shared processor, or by a plurality of individual processors, some of which may be shared or distributed. Moreover, explicit use of the term "processor" or "controller" should not be construed to refer exclusively to hardware capable of executing software, and may include, without limitation, digital signal processor (DSP) hardware, read only memory (ROM) for storing software, random access memory (RAM), and non-volatile storage.

As shown in FIG. 4A-FIG. 4I, in an example embodiment the sheet deflector 24 comprises a deflector cover 52, a fluid manifold 54; and a deflector rod 56. The port 36 is defined in the deflector cover 52. The fluid manifold 54 is situated within the deflector cover 52 and in fluid communication with the port 36. The deflector rod 56 is attached to the deflector cover 52 and collinear with the major axis 34.

As shown in FIG. 4A-FIG. 4I, the deflector cover 52 is configured with a predetermined profile in a cross section plane perpendicular to the major axis 34. The predetermined profile has a flat profile segment 60 and a curved (essentially semi-circular) profile segment 62 arranged whereby the sheet deflector 24 rolls through at least a portion of its curved profile segment 62 onto the top sheet-to-be-fed (sheet 32) to bring the flat profile segment 60 in flush contact with the top sheet-to-be-fed, the flat profile segment 60 of the sheet deflector 24 having the port 36 provided therein.

Sheet feeder 20 further comprises a holding arm 70; a deflector carriage 72, and an actuator 74. The holding arm 70 is positioned and arranged for selectively contacting a next sheet-to-be-fed when the sheet extractor 26 engages the top sheet-to-be-fed. The deflector carriage 72 is arranged for carrying the sheet deflector 24 and pivotally connected to the holding arm 70. The actuator 74 serves for providing relative pivotal movement about a pivot axis 76 of the holding arm 70 and the deflector carriage 72. Both holding arm 70 and deflector carriage 72 are attached to an unillustrated main frame of sheet feeder 20 at pivot axis 76.

Figure 2:
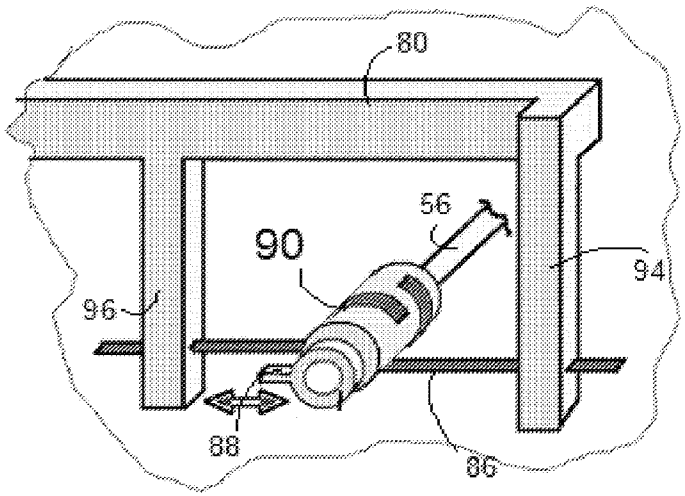
FIG. 2 is a diagrammatic view of a sub-assembly of the automated sheet feeding apparatus of FIG. 1.

In an example implementation, the deflector carriage 72 comprises a carriage frame 80; a carriage actuator 82; and two guide belts 84, 86. It will be appreciated that the carriage frame 80 structure shown in FIG. 1 as a right side perspective view has an essential mirror image on the left side, with the left side also having two guide belts 84, 86 (two pairs of guide belts thus being provided) and preferably but optionally having a second carriage actuator 82. The carriage frame 80 is pivotally connected to the holding arm 70 has had two spaced-apart carriage projections extending therefrom. The carriage actuator 82 has a first end connected to the carriage frame 80 and (at its second end) a piston 88. The piston 88 is rigidly connected to a bearing 90. As shown in FIG. 2, bearing 90 permits rotation of the sheet deflector 24 about the major axis 34 of the sheet deflector 24. A first guide belt 84 has a first end connected to a first of the two carriage projections (i.e., carriage projection 92) and a second end connected to the bearing 90. A second guide belt 86 has a first end connected to a second of the two carriage projections (i.e., carriage projection 94) and a second end connected to the bearing 90. The first guide belt 84 and the second guide belt 86 are respectively wrapped in clockwise and counter-clockwise directions about the bearing 90.

The carriage frame 80 of sheet deflector 24, holding arm 70, and sheet extractor 26 control sheet movement alternatively. In order to achieve the right sequence, a "scissor like" mechanism comprised of two arms, e.g., carriage frame 80 of sheet deflector 24 and holding arm 70, pivots around axis 76. These two mechanisms alternatively rest on (and hold) the pile of sheets (8), e.g., stack 28, in sheet hopper 22. The movement of these two mechanisms is controlled by actuator 74, which can be an air cylinder. The carriage frame 80 of sheet deflector 24 holds or carries carriage actuator 82, so that carriage actuator 82 can push/pull sheet deflector 24.

Through the sub-assembly shown in FIG. 2, sheet deflector 24 the bar is forced to rotate about its axis 34 as it follows a path guided by two guide belts 84, 86. In this regard, The bearing 90 (which can be a ball bearing) is moved horizontally by action of piston 88 of carriage actuator 82, with the inside circle of bearing 90 allowing rotation of deflector rod 56. At the same time, the deflector rod 56 of sheet deflector 24 will rotate the other end too and though second guide belts 86 will translate, forcing parallel movement of sheet deflector 24. This special sub-assembly allows a high degree of repeatability between the end positions. In addition, the flexibility of the two guide belts 84, 86 compensates for irregularities of stack 28.

In one stable position (when actuator 74 is contracted), the paper pile (e.g., stack 28) holds or supports sheet deflector 24 and (through the sub-assembly of FIG. 2) the weight of carriage frame 80. At the same time, carriage frame 80, sheet deflector 24, carriage actuator 82, and actuator 74 cooperate to hold holding arm 70 in the upper position.

In a second stable position, the holding arm 70 (which serves as a "stopper") rests on the paper pile (e.g., stack 28) and acting through actuator 74 (when extended) to lift holding arm 70 and carriage frame 80 of sheet deflector 24.

Basic steps involved in an example mode of a method of operating a sheet feeder such as sheet feeder 20 (for feeding sheets in a conveyance direction 30) are illustrated, at least in part, by FIG. 4A-FIG. 4I. FIG. 4A-FIG. 4I are not intended to be exhaustive in discussing operational aspects of sheet feeder 20, and therefore are understood as illustrating only a portion of the structure of sheet feeder 20, predominately the structure of sheet deflector 24 as it coacts with a sheet 32.

Figure 4C:
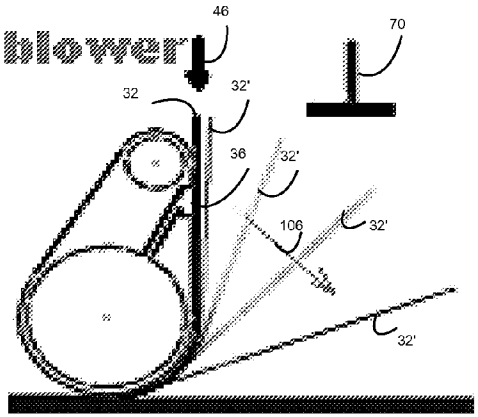
Figure 4B:
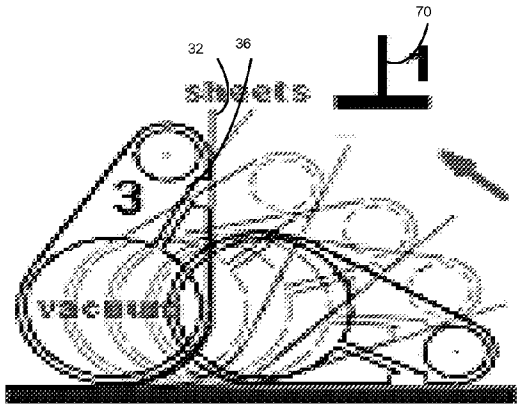
Figure 4A:
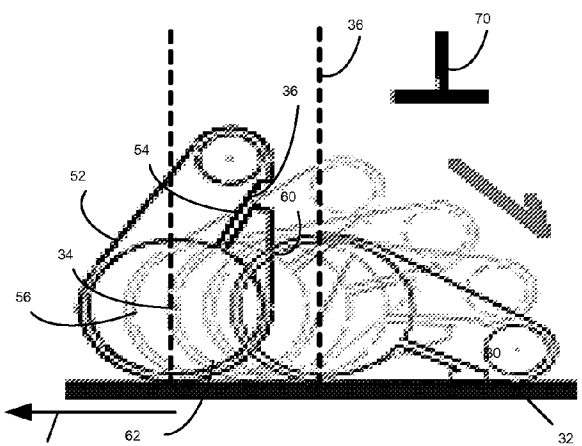

FIG. 4A depicts a step of rotating the sheet deflector 24 about major axis 34 of the sheet deflector 24 into essentially flush contact with at portion of the trailing edge of the top sheet-to-be-fed from the sheet, thereby translating sheet deflector 24 from a nominal position (depicted by line 100 through axis 34) to a sheet acquisition position (depicted by line 102 through axis 34) in a plane parallel to a conveyance direction 30 (the sheet acquisition position 102 being closer to a trailing edge of a top sheet-to-be-fed (sheet 32) from sheet stack 28 than the nominal position 100). In the step of FIG. 4A, sheet deflector 24 is rotated in a clockwise direction about its axis 34.

As shown in FIG. 4A, sheet deflector 24 has a circular bottom zone, e.g., curved profile segment 62, which is adapted for rolling on a surface and flat profile segment 60 that allows vacuum through flat profile segment 60. The curved profile segment 62 of sheet deflector 24 rolls over about axis 34 onto the sheet border, and applies suction to the upper sheet 32 through port 36. In the same time, sheet deflector 24 blocks sheet 32 from leaving stack 28, which is necessary because a "pull" force is constantly applied by sheet extractor 26. After being rolled onto the uppermost sheet 32, controller 50 issues a signal to a vacuum source to cause a vacuum to be applied through port 36 of sheet deflector 24, thereby attracting the top sheet-to-be-fed (sheet 32) to the sheet deflector 24, and particularly to flat profile segment 60 of deflector cover 52.

One reason for sheet deflector 24 to roll on the stack/pile is to have essentially permanent contact with the first sheet (sheet 32), keeping sheet 32 from being pulled by sheet extractor 26 at this point in time. The whole weight of the carriage frame 80 (and through actuator 74 the holding arm 70) rests in this sequence on the pile through sheet deflector 24. Similarly, when actuator 74 is retracted, holding arm 70 rests on the pile raising carriage frame 80 and (through sheet deflector 24) the sheet.

FIG. 4B shows a stage of operation wherein sheet deflector 24 rolls back, i.e., is rotated counterclockwise about its axis 34, with sheet 32 attracted thereto by the vacuum applied through port 36. In other words, FIG. 4B shows rotating the sheet deflector 24 about the major axis 34 of the sheet deflector 24 for moving the top sheet-to-be-fed from a sheet undeflected acquisition position 102 to a sheet deflected position 104 while the vacuum is applied through the port 36.

FIG. 4C shows an example step in which singulator 44 separates the edge of the second sheet 32', which could have also been picked up by sheet deflector 24 along with the first sheet 32. The singulator 44 performs this duplicate separation by directing air in the direction depicted by arrow 46 in FIG. 4C. This separation is beneficial because the thin sheet may allow the vacuum to pass through the first sheet 32 to a degree sufficient to pull another page, e.g., sheet 32'. Vacuum attraction of double sheets may occur as much as about 60% of the time. The first sheet 32, picked up by sheet deflector 24, will remain attached to sheet deflector 24, but the extra page (sheet 32') will be blown off by singulator 44 and will fall back onto the stack 28 (as depicted by arrow 106 and a time elapsed sequence of positions for sheet 32' depicted in FIG. 4C).

Figure 4D:
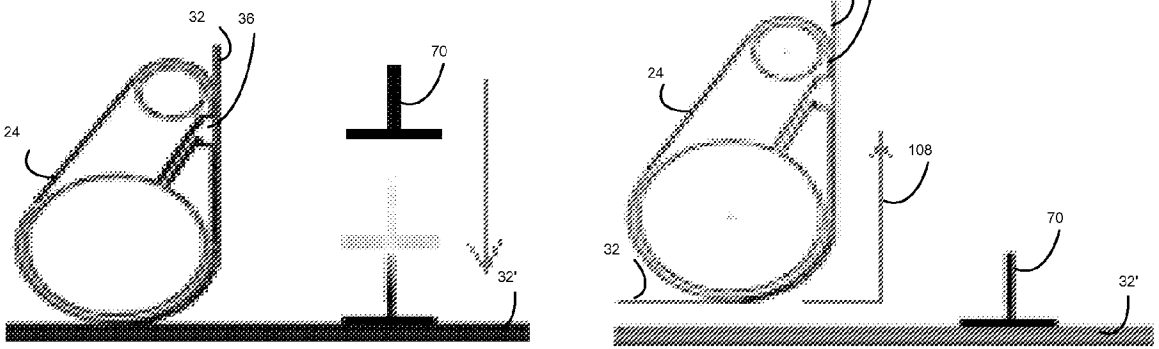

FIG. 4D illustrates an operation in which, after any extra sheet 32' may have returned to stack 28, the holding arm 70 is operated (via actuator 74 under supervision of controller 50) to fall back on stack 28. In other words, after a precise time delay determined by controller 50, holding arm 70 falls down onto the stack 28 of paper, holding the next page 32'(at the top of the stack) in place.

Figure 4E:
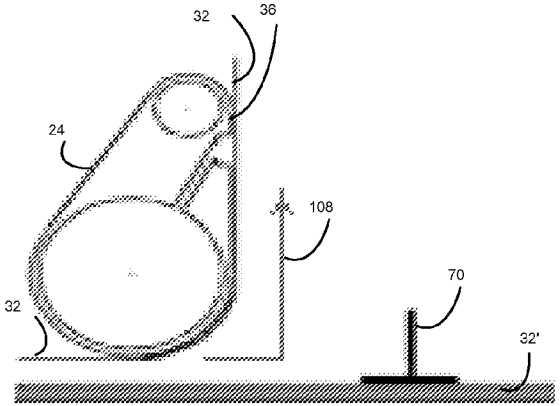

FIG. 4E shows an example step of translating the sheet deflector 24 in a direction perpendicular to the conveyance direction 30 (i.e., in the direction of arrow 108) for selectively lifting the top sheet-to-be-fed (sheet 32) from the sheet stack 28. That is, sheet deflector 24 lifts off the first sheet 32, creating a space between the first sheet 32 and second sheet 32'.

Figure 4F:
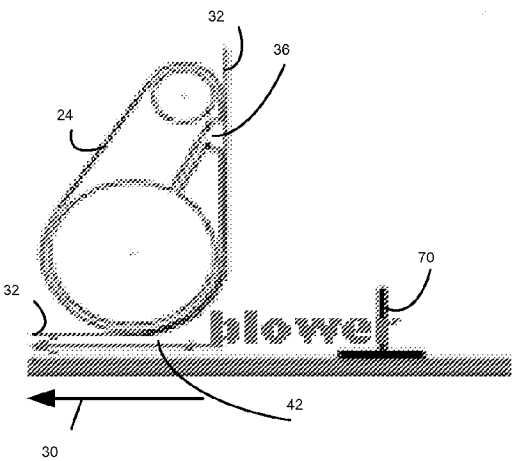

FIG. 4F shows an example step of extracting the top sheet-to-be-fed (sheet 32) from the sheet deflector 24 in the conveyance direction 30. As part of the step of FIG. 4E, under timing supervision of controller 50 the separator 40 applies fluid in the direction shown by arrow 42 in FIG. 4F. That is, separator 40 blows into a gap to separate the rest of page 32 from the remainder of stack 28.

Just after the time shown in FIG. 4F, controller 50 directs that the suction holding sheet 32 via port 36 be released and further directs that compressed gas from source 48 (rather than vacuum) be applied through port 36 of sheet feeder 20. These actions result in page 32 being released from the sheet deflector 24, so that sheet 32 can be pulled by sheet extractor 26 in the conveyance direction 30 toward the next processing machine or station. Consequently, as shown in FIG. 4G, after release and extraction of sheet 32, no sheets are engaged by sheet deflector 24.

FIG. 4H shows another example step of operation of sheet feeder 20 wherein sheet deflector 24 falls back onto the stack 28 of sheets, thereby securing the topmost page (now page 32'). FIG. 4I shows the subsequent example step of holding arm 70 being lifted from stack 28 and sheet deflector 24 returning in the direction perpendicular to the conveyance direction 30 to rest on the sheet stack 28.

Thus, FIG. 4A-FIG. 4I describe a cycle or sequence of example steps of operation. The steps of operation are repeated for each sheet-to be-fed. In other words, the example steps of FIG. 4A-FIG. 4I are next followed by a cycle of similar operations involving the next topmost sheet on stack 28, i.e., sheet 32'.

The sheet feeder 20 thus "measures" the height of the paper stack 28 as, at times, sheet deflector 24 lies directly on top of stack 28, allowing easy height control of the pile.

In another embodiment, the separation/deflection mechanism is placed under the stack 28 instead of above the stack. In other words, with appropriate alterations and orientation changes, in other embodiments the sheet feeder can function as a bottom feeder rather than a top feeder.

The sheet feeder 20 is particular useful when the next processing machine or station is a laminator or the like. The sheet feeder 20 is also advantageous for use with other types of processing machines or stations.

An advantage of the technology includes low consumption of vacuum. That is, for example, no on-board (loud and expensive) vacuum pump is needed. Rather, the sheet feeder can instead utilize a Bernoulli vacuum generator.

Although various embodiments have been shown and described in detail, the claims are not limited to any particular embodiment or example. None of the above description should be read as implying that any particular element, step, range, or function is essential. The invention is not to be limited to the disclosed embodiment, but on the contrary, is intended to cover various modifications and equivalent arrangements.

What is claimed is:

1. A sheet feeder apparatus for feeding sheets in a conveyance direction, the apparatus comprising:

a sheet hopper for orienting sheets-to-be-fed in a stack, the sheets of the stack lying essentially parallel to a conveyance direction while lying undeflected in the sheet hopper;

a sheet deflector for deflecting a top sheet-to-be-fed from the sheet stack from a sheet undeflected acquisition position to a sheet deflected position, the sheet deflector having a major axis oriented essentially parallel to a trailing edge the top sheet-to-be-fed from the sheet stack, the sheet deflector having a port through which suction is selectively applied to the top sheet-to-be-fed, the sheet deflector being adapted for:

selective rotation about the major axis for moving the top sheet-to-be-fed from the sheet undeflected acquisition position to the sheet deflected position while the suction is applied through the port;

selective translation in a direction perpendicular to the conveyance direction for selectively lifting the top sheet-to-be-fed from the sheet stack in the sheet deflected position and selectively resting on the sheet stack;

a sheet extractor for engaging at least a leading edge of the top sheet-to-be-fed when in its sheet deflected position and for directing the top sheet-to-be-fed in the conveyance direction;

a holding arm positioned for selectively contacting a next sheet-to-be-fed when the sheet extractor engages the top sheet-to-be-fed;

a deflector carriage for carrying the sheet deflector and pivotally connected to the holding arm;

an actuator for providing relative pivotal movement about a pivot axis of the holding arm and the deflector carriage.

2. The apparatus of claim 1, wherein the deflector carriage comprises:

a carriage frame which is pivotally connected to the holding arm, the carriage frame having two spaced-apart carriage projections extending therefrom;

a carriage actuator having a first end connected to the carriage frame and a piston, the piston being rigidly connected to a bearing, the bearing permitting rotation of the sheet deflector about the major axis of the sheet deflector;

a first guide belt having a first end connected to a first of the two carriage projections and a second end connected to the bearing;

a second guide belt having a first end connected to a second of the two carriage projections and a second end connected to the bearing, the first guide belt and the second guide belt being respectively wrapped in clockwise and counter-clockwise directions about the bearing.

3. The apparatus of claim 1, further comprising a separator for separating the top sheet-to-be-fed when in its sheet deflected position from a remainder of the stack.

4. The apparatus of claim 3, wherein the separator comprises a source of fluid for blowing fluid between the top sheet-to-be-fed when in its sheet deflected position and the sheet stack for separating the top sheet-to-be-fed from the remainder of the stack.

5. The apparatus of claim 1, further comprising a sheet singulator for separating the top sheet-to-be-fed when in its sheet deflected position from another sheet which may be in its sheet deflected position and thereby returning the another sheet to the sheet stack

6. The apparatus of claim 5, wherein the sheet singulator comprises a source of fluid for blowing fluid between the top sheet-to-be-fed when in its sheet deflected position and another sheet which may be in its sheet deflected position and thereby returning the another sheet to the sheet stack.

7. The apparatus of claim 1, further comprising a source of compressed gas for applying compressed gas through the port of the sheet deflector to the top sheet-to-be-fed when in its sheet deflected position and when the extractor is engaging the top sheet-to-be-fed.

8. The apparatus of claim 1, further comprising a controller for controlling timing of:

the rotation of the sheet deflector;

the application of suction though the port of the sheet deflector to the top sheet-to-be-fed;

the translation of the sheet deflector in the direction perpendicular to the conveyance direction.

* * * * *

UNITED STATES PATENT AND TRADEMARK OFFICE

CERTIFICATE OF CORRECTION

PATENT NO. : 7,665,723 B2
APPLICATION NO. : 11/533960
DATED : February 23, 2010
INVENTOR(S) : Marian V. Gogoana It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 470 days.

Signed and Sealed this

Seventh Day of December, 2010

David J. Kappos

David J. Kappos
*Director of the United States Patent and Trademark Office*